US006047745A

United States Patent [19]

Fournier

[11] Patent Number: 6,047,745

[45] Date of Patent: Apr. 11, 2000

[54] PROCESS FOR THE RECOVERY OF STEAM EMITTED IN A LIQUID DISTRIBUTION PLANT

[75] Inventor: Jacques Fournier, Bretigny-sur-Orge, France

[73] Assignee: Tokheim Services France, Le Plessis Robinson, France

[21] Appl. No.: 09/000,416

[22] PCT Filed: Jul. 29, 1996

[86] PCT No.: PCT/FR96/01217

§ 371 Date: Feb. 3, 1998

§ 102(e) Date: Feb. 3, 1998

[87] PCT Pub. No.: WO97/06095

PCT Pub. Date: Feb. 20, 1997

[30] Foreign Application Priority Data

Aug. 10, 1995 [FR] France ..... 95 09796

[51] Int. Cl.[7] ..... B67D 5/04

[52] U.S. Cl. ..... 141/59; 141/7; 141/45; 141/290

[58] Field of Search ..... 141/45, 59, 290, 141/7

[56] References Cited

U.S. PATENT DOCUMENTS

| | | | |
|---|---|---|---|
| 5,038,838 | 8/1991 | Bergamini et al. | 141/59 |
| 5,156,199 | 10/1992 | Hartsell, Jr. et al. | 141/59 |
| 5,332,008 | 7/1994 | Todd et al. | 141/59 |
| 5,417,256 | 5/1995 | Hartsell, Jr. et al. | 141/7 |
| 5,507,325 | 4/1996 | Finlayson | 141/59 |
| 5,542,458 | 8/1996 | Payne et al. | 141/7 |

FOREIGN PATENT DOCUMENTS

| | | | |
|---|---|---|---|
| 4200803 | 7/1993 | Germany | 141/59 |

*Primary Examiner*—J. Casimer Jacyna
*Attorney, Agent, or Firm*—Randall J. Knuth

[57] ABSTRACT

A method of recovering vapor emitted in a liquid dispensing installation comprising: liquid dispensing means ($P_L$) adapted to cause said liquid to flow with a liquid flowrate $Q_L$; vapor recovery means ($P_V$) adapted to cause said vapor to flow with a vapor flowrate $Q_V$ along a pipe (120), said vapor flowrate $Q_V$ being controlled by a parameter G. According to the invention, the method includes the following steps: establishing an equation G=F ($Q_V$, $\{p_i\}$) relating the parameter G to the vapor flowrate $Q_V$ and to parameters $p_i$ characteristic of the recovery means and said pipe (120); determining an initial value $\{p_i\}_o$ of the parameters $p_i$; on each dispensing k of liquid: measuring the liquid flowrate $Q_{Lk}$ and determining a value $G_k$ of the parameter G from the equation:

$$G_k=F\ (Q_{Lk}, \{p_i\}_{k-1});$$

determining a new value $\{p_i\}_k$ of the parameters $p_i$ to be used for the next dispensing k+1 of liquid. Application to dispensing fuel for motor vehicles.

11 Claims, 3 Drawing Sheets

PROCESS FOR THE RECOVERY OF STEAM EMITTED IN A LIQUID DISTRIBUTION PLANT

FIELD OF THE INVENTION

The present invention concerns a method of recovering vapor emitted by an installation for dispensing a liquid while said liquid is being dispensed into a tank.

The invention finds a particularly advantageous application in the field of dispensing fuel for motor vehicles, for example, for recovering the hydrocarbon vapor that escapes from the tank of the vehicle while it is being filled with liquid fuel.

BACKGROUND OF THE INVENTION

An installation for dispensing liquid such as fuel for motor vehicles generally comprises means for dispensing said liquid essentially comprising volumeters fitted with pumps adapted to cause the fuel to flow with a liquid flowrate $Q_L$ between a storage tank and the fuel tank of the vehicles. The volumeters also include a liquid measuring device connected to a pulse generator enabling a computer to establish the volume and the price of the fuel delivered, which are shown in the clear on a display with which the volumeters are equipped.

If the hydrocarbon vapor emitted is to be recovered, said installation includes recovery means adapted to cause said vapor to circulate with a vapor flowrate $Q_V$ along a pipe between the vehicle fuel tank and a recovery tank, for example the storage tank, the vapor flowrate $Q_V$ being controlled by a parameter G characteristic of said recovery means so as to maintain between the vapor flowrate $Q_V$ and the liquid flowrate $Q_L$ a relation of proportionality $Q_V=kQ_L$ with k equal to or close to 1.

Said recovery means usually comprise a pump aspirating the vapor from the fuel tank in order to return it to the hydrocarbon storage tank. The characteristic parameter G is the rotation speed w of said pump which is controlled by the pulse generator of the dispensing means.

However, in most cases there is no simple way to impose a pump speed w proportional to the liquid flowrate $Q_L$.

Operating conditions can differ greatly from one installation to another, in terms of:

- head losses in the recovery pipe upstream and downstream of the pump,
- the possible presence of calibrated valves at the recovery tank which can generate within the latter a pressure different from atmospheric pressure and corresponding to an additional hydraulic resistance on the recovery pipe,
- internal leakage of the recovery pump, dependent on the upstream-downstream pressure difference, which affects its efficiency.

To summarize, to obtain a given vapor flowrate $Q_V$, it is necessary to impose on the recovery pump a rotation speed w that depends on the installation.

To allow for the parameters mentioned above it is standard practice to calibrate the complete installation when installed on the site. During this calibration a recovery pump speed w is fixed and the corresponding vapor flowrate $Q_V$ is measured using a flowmeter or a gas meter. A table (w, $Q_V$) is drawn up in this way relating the speed w and the vapor flowrate $Q_V$ with a sufficient number of points to define the characteristic of the pump under these operating conditions. This table is stored in memory in a microprocessor.

In normal operation, the flowmeter is removed and, during dispensing of hydrocarbons at a liquid flowrate $Q_L$, the microprocessor looks up in the table the speed w to be imposed on the recovery pump such that $Q_V=Q_L$.

This prior art recovery method has the following disadvantages, however:

- head losses in the recovery pipe can vary with time because of:
  - progressive partial blocking with dust,
  - a change in the cross-section of the elastomer hoses due to the prolonged presence of hydrocarbons. This applies in particular to the part of the pipe upstream of the pump, which generally comprises an elastomer tube surrounded with pressurized liquid, this part representing the core of a coaxial hose.
- the internal leakage of the pump can vary because of wear, as in vane pumps, for example.
- the density of the vapor varies with the nature of the hydrocarbons and the temperature of the vehicle fuel tanks, which modifies the effect of the upstream and downstream head losses.
- the vapor pressure in the recovery tank can also vary with the nature of the hydrocarbons and the temperature.

SUMMARY OF THE INVENTION

The technical problem to be solved by the present invention is that of proposing a method of recovering vapor emitted in a liquid dispensing installation when dispensing said liquid into a tank, said installation comprising:

- liquid dispensing means adapted to cause said liquid to flow with a liquid flowrate $Q_L$ between a storage tank and said tank,
- vapor recovery means adapted to cause said vapor to flow with a vapor flowrate $Q_V$ along a pipe between said tank and a recovery tank, said vapor flowrate $Q_V$ being controlled by a parameter G characteristic of said recovery means, which method, given the slow evolution of the parameters characteristic of the flow of vapor along the recovery pipe, would enable deferred recalibration of the characteristic parameter G as a function of the vapor flowrate $Q_v$.

In accordance with the present invention, the solution to this technical problem resides in the fact that said method includes the following steps:

establishing an equation $$G=F(Q_v, \{P_i\})$$

relating the parameter G to the vapor flowrate $Q_V$ and to parameters $p_i$ characteristic of the recovery means and said pipe, determining an initial value $\{P_i\}_o$ of the parameters $P_i$, on each dispensing k of liquid:

measuring the liquid flowrate $Q_{Lk}$ and determining a value $G_k$ of the parameter G to be imposed on the recovery means by the equation:

$$G_k=F(Q_{Lk}, \{P_i\}_{k-1})$$

determining a new value $\{P_i\}_k$ of the parameters $P_i$ to be used for the next dispensing k+1 of liquid.

Accordingly, during dispensing of liquid, a value determined from parameters calculated during the preceding dispensing is used for the characteristic parameter G and at least one measurement is effected in order to calculate new values for said parameters that will be used for the next dispensing.

As will be seen in detail below, two particular, but not exclusive, embodiments of the method of the invention are proposed.

In a first embodiment, the recovery means comprising a pump, said parameter G is the rotation speed w of said pump.

In a second embodiment, the recovery means comprising a pump and a solenoid valve, said parameter G is the hydraulic resistance imposed by said solenoid valve, the rotation speed w of the pump being constant. To a first approximation, the various parameters $p_i$ characteristic of the recovery means and of the pipe are considered to be independent of the vapor flowrate $Q_v$. Nevertheless, some of these parameters may vary with said vapor flowrate. This applies in particular to the internal leakage coefficient a of vane pumps if the vanes are not precisely guided. The method of the invention must therefore be adapted to suit this particular situation. This is why, in accordance with the invention, there is provision for one parameter p of the parameters $p_i$ to vary with the vapor flowrate $Q_V$:

an initial table $[p_o^j, Q_V^j]$ (j=1, . . . , N) is established linking N values of the parameter p to N values of the vapor flowrate $Q_V$, on each dispensing k of liquid:

a value $p^j_{k-1}$ of the parameter p is used in the equation $$G_k=F(Q_{Lk}, \{p_i\}_{k-1})$$

such that $[p^j]_{k-1}, Q^j_V=Q_{Lk}]$ the vapor flowrate $Q_{Vk}$ is measured and a corresponding value $p_k$ of the parameter p is determined, a coefficient $A_k$ is calculated such that $$A_k=p_k/p^{j'}_o \text{ with } [p^{j'}_o, Q^{j'}_V=Q_{Vk}]$$

a new table $[p^j_k, Q^j_V]$ is established for all values of j with $p^j_k=A_k p^j_o$.

BRIEF DESCRIPTION OF THE DRAWINGS

The following description with reference to the accompanying drawings, given by way of non-limiting example, shows in what the invention consists and how it can be put into practice.

DETAILED DESCRIPTION OF THE PREFERRED EMBODIMENTS

Figure 1:
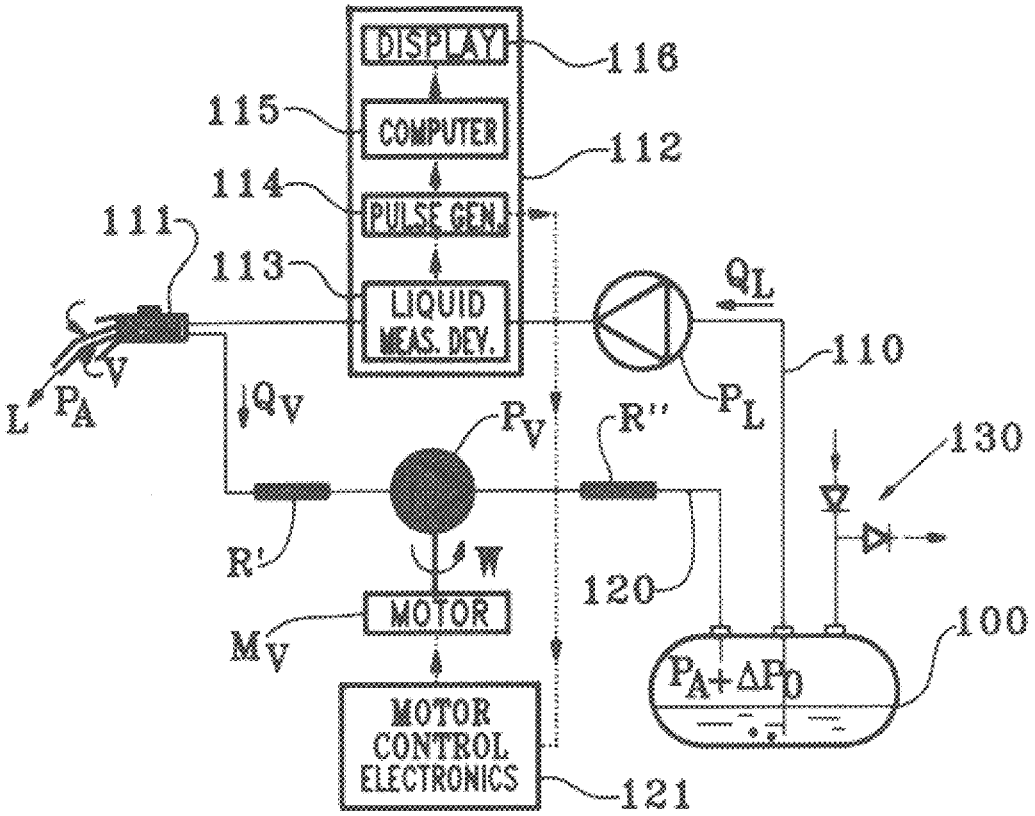
FIG. 1 is a general schematic of a liquid dispensing installation using a vapor recovery method of the invention.

The FIG. 1 schematic shows an installation for dispensing liquid, for example fuel, into the fuel tank of a vehicle, not shown.

The installation comprises fuel dispensing means essentially consisting of a pump $P_L$ adapted to cause said fuel L to flow with a liquid flowrate $Q_L$ between a storage tank 100 and said fuel tank along a pipe 110 to a dispensing nozzle 111.

As mentioned above, a volumeter 112, possibly incorporating the liquid pump $P_L$, includes a measuring device 113 disposed on the pipe 110 in series with the pump $P_L$ so that a pulse generator 114 coupled to said measuring device 113 supplies a pulse signal representative of the liquid flowrate $Q_L$ that a computer 115 then converts into a volume and a price sent to a display 116.

The FIG. 1 installation also comprises means for recovering the vapor V emitted during the dispensing of the liquid into the fuel tank of the vehicle. In the FIG. 1 example, said recovery means primarily comprise a pump $P_V$ adapted to cause said vapor to flow at a vapor flowrate $Q_V$ along a pipe 120 between the fuel tank, via the dispensing nozzle 111, and a recovery tank 100 which, in FIG. 1, is the liquid fuel storage tank.

Generally speaking, the recovery method of the invention consists in imposing on a parameter G characteristic of the recovery means, the rotation speed w of the pump $P_V$ in the FIG. 1 example, a value such that the resulting vapor flowrate $Q_V$ is as close as possible to the liquid flowrate $Q_L$.

To this end, there is established and stored in the memory of a circuit 121 controlling the motor $M_V$ of the pump $P_V$ an equation $$G=F(Q_V, \{p_i\})$$

linking the parameter G to the vapor flowrate $Q_V$ and to parameters $p_i$ characteristic of the recovery means and of the recovery pipe 120, these parameters being explained hereinafter on an individual basis.

Then, after determining an initial value $\{p_i\}_o$ of the parameters $p_i$, on each dispensing k of liquid the liquid flowrate $Q_{Lk}$ is measured using information supplied by the pulse generator 114 to the control circuit 121 of the motor $M_V$. The value $G_k$ of the parameter G to be imposed on the recovery means is then determined by the equation $$G_k=F(Q_{Lk}, \{p_i\}_{k-1})$$

in which $\{p_i\}_{k-1}$ represents the value of the parameters $p_i$ calculated during the previous dispensing k−1 of liquid.

During this dispensing k of liquid, a new value $\{p_i\}_k$ of the parameters $p_i$ to be used for the next dispensing k+1 of liquid is determined.

The recovery method of the invention is based on the idea of deferred updating of the parameters governing the flow of vapor in the recovery pipe 120. Because the updating is done from one dispensing of liquid to the next, the systematic error inherent in the method remains negligible given the very slow drift with time of the parameters $p_i$ that are essentially related to the vapor pump $P_V$ and to the head losses in the pipe 120.

Figure 2:
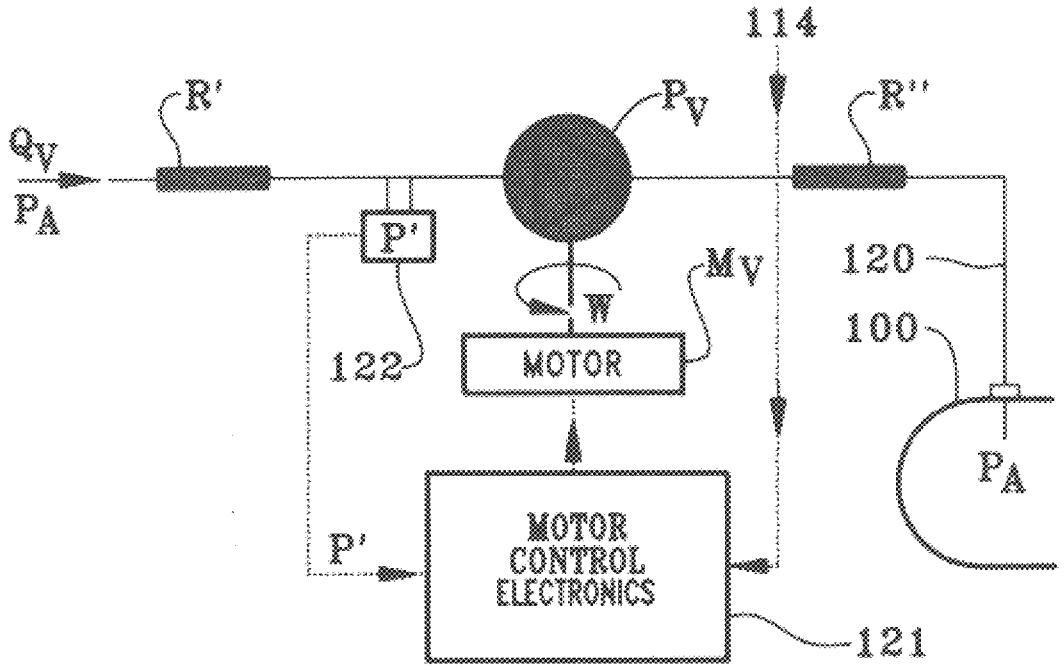
FIG. 2 is a schematic of the vapor recovery circuit from FIG. 1 in the case where the recovery pump has no internal leaks.

FIG. 2 shows a first example of an application of the method of the invention. In this example the recovery means comprise the vapor pump $P_V$ the rotation speed w of which constitutes the parameter G controlling the vapor flowrate $Q_V$.

Assuming that the pump $P_V$ has no internal leakage (coefficient $\alpha$=0), that the vapor is recovered at atmospheric pressure $P_A$ and that the recovery tank 120 is also at atmospheric pressure $P_A$ (zero pressure rise or pressure drop $\Delta$Po), the equation linking the rotation speed w of the pump $P_V$ and the vapor flowrate is written:

$$w=Q_V/V_G\ (P'/P_A) \quad (1)$$

where $V_G$ is the geometrical cyclic volume of the pump and P' is the pressure at the pump inlet. If R' is the hydraulic resistance in the upstream part of the recovery pipe 120:

$$P_A - P' = R' Q_V^n \quad (2)$$

where n is equal to 7/4, but can be taken as equal to 2 for simplicity.

The equation (1) is then written:

$$w = Q_V / V_G \, (1 - R' Q_V^n / P_A)$$

which represents the general formula G=F ($Q_V$, $\{p_i\}$), the parameters $p_i$ being the geometrical cyclic volume $V_G$ and the upstream hydraulic resistance R'. The parameter $V_G$ is constant and can be measured once and for all at the factory. The initial value R'o of the parameter R' is determined by means of the equation (2) by imposing any rotation speed w on the pump $P_V$ and measuring the pressure P' using a pressure sensor 122 and possibly a flowmeter, not shown, that supplies the corresponding vapor flowrate $Q_V$. After this initialization phase the flowmeter is removed. The values of $V_G$ and R'o are stored in a memory of the control circuit 121 of the motor $M_V$ of the pump $P_V$.

On the first dispensing of liquid said control circuit calculates the speed $w_1$ to be imposed on the pump from the previously measured values $V_G$, R'o and the liquid flowrate $Q_{L1}$ received from the pulse generator 114 using the equation:

$$W_1 = Q_{L1} / V_G (1 - R'o Q^n_{L1} / P_A)$$

During this first dispensing, a measurement $P'_1$ of the pressure P' is effected, for calculating the new value $R'_1$ of R' using two equations:

$$Q_{v1} = w_1 \, V_G \, P'_1 / P_A$$

$$R'_1 = (P_A - P'_1) / Q''vl$$

$R'_1$ is used on the second dispensing, and so on.

Figure 3:
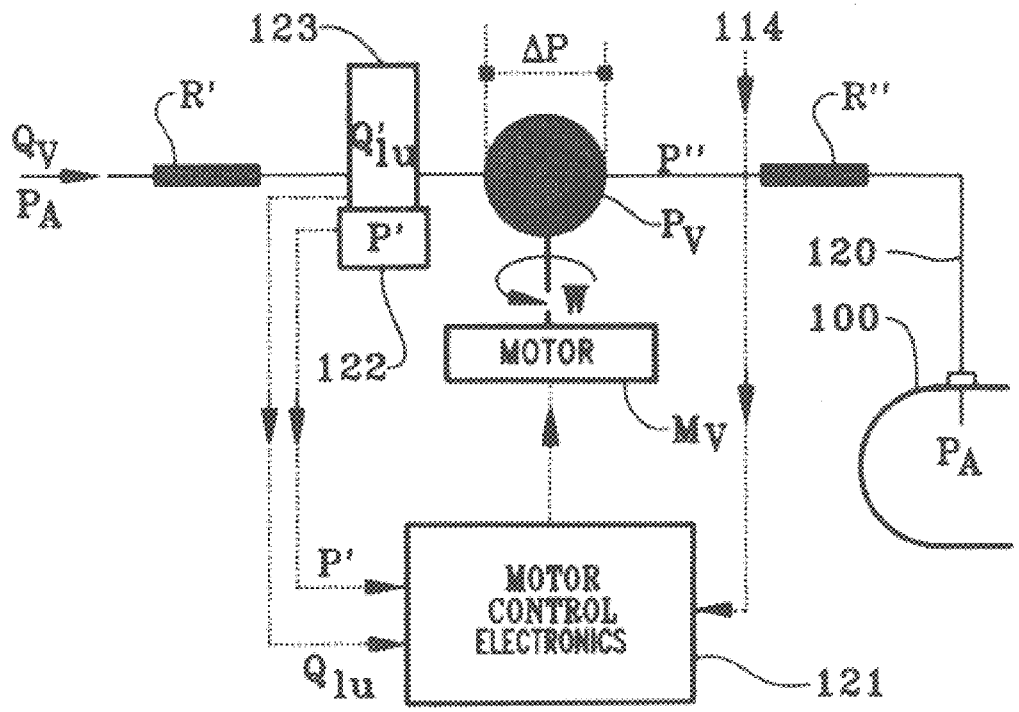
FIG. 3 is a schematic of the vapor recovery circuit from FIG. 1 in the case where the recovery pump has an internal leak.

The FIG. 3 schematic concerns a vapor pump $P_V$ having an internal leak (non-zero value of coefficient α).

The general equation of the vapor recovery circuit is written:

$$w = Q_V / V_G (P' / P_A) + \alpha \Delta P \quad (3)$$

ΔP being the pressure difference across the pump $P_V$.

ΔP is related to the vapor flowrate $Q_V$ by the equation:

$$\Delta P = (R' + R'') Q^n_V = R \, Q^n_V$$

R" being the hydraulic resistance downstream of the recovery pipe 120.

Given that the following still applies $$P_A - P' = R' Q^n_V$$

equation (3) is then written $$W = Q_V / V_G (1 - R' Q_V^n / P_A) + (\alpha R) Q_V^n$$

The parameters $p_i$ characteristic of the recovery circuit are therefore $V_G$, R' and αR. As previously, the geometric cyclic volume $V_G$ of the pump, which is constant, is measured in the factory. The parameters R' and αR can be determined using an upstream pressure P' sensor 122 and a flowmeter 123 at the inlet of the pump $P_V$ to measure the vapor flowrate $Q_V$. In reality, the flowrate $Q_{1u}$ supplied by the flowmeter 123 must be corrected for the pressure P':

$$Q_V = Q_{1u} (P' / P_A)$$

This is done automatically by the control circuit 121 of the motor $M_V$ which receives P' and $Q_{1u}$ in addition to the liquid flowrate $Q_L$.

Given these conditions, the values of R' and αR are linked to $Q_V$ and P' by the equations:

$$R' = (P_A - P') / Q^n_V$$

$$(\alpha R) = [w - Q_V / V_G (1 - R' Q^n_V / P_A)] / Q^n_V$$

The initial values R'o and (αR)o can be determined during a first dispensing k=o during which the rotation speed w of the pump $P_V$ is measured.

A pressure sensor P", not shown, can be placed at the outlet of the pump $P_V$ if the downstream hydraulic resistance R" has to be known, for example to monitor the condition of the pipe 120 downstream of the pump or to detect a problem. R" is deduced from:

$$R'' = (P_A - P'') / Q^n_V$$

Figure 4:
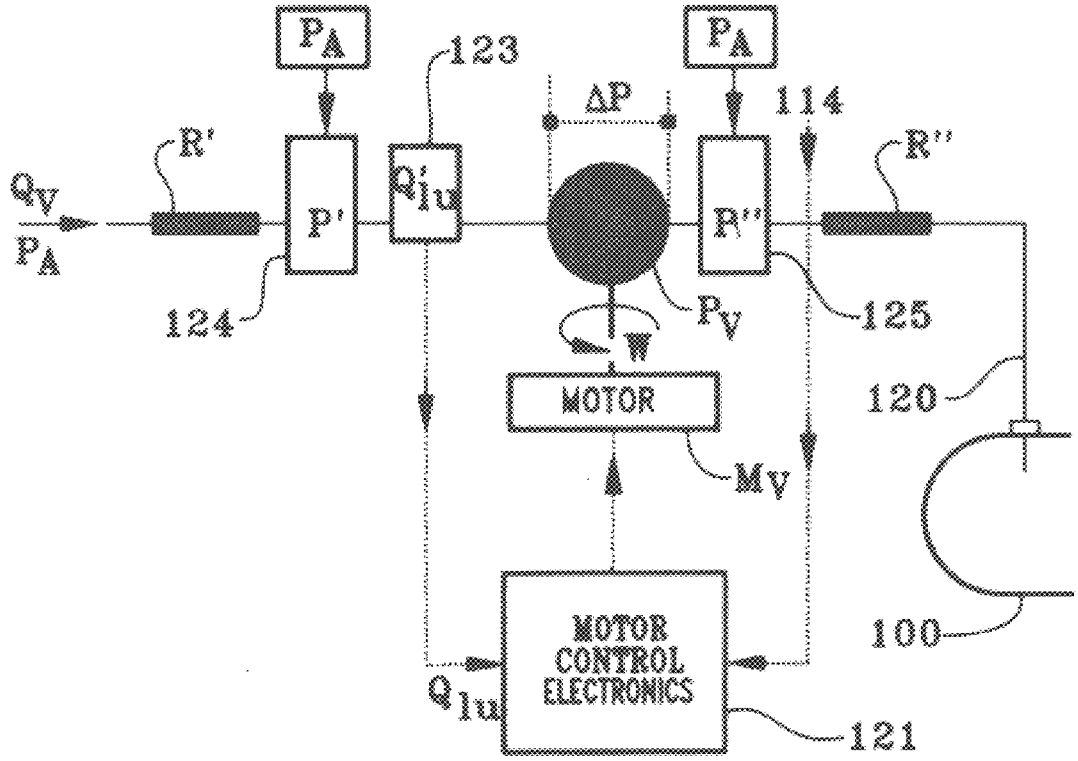
FIG. 4 is a schematic of the vapor recovery circuit from FIG. 1 using two pressure regulators.

The embodiment shown in the FIG. 4 schematic is designed to simplify the updating of the parameters $p_i$. To this end, the pressure P' sensor 122, and possibly that giving the pressure P", is dispensed with and respective pressure regulators 124 and 125 are disposed at the inlet and at the outlet of the pump $P_V$. The regulator 124 is set to a set point value corresponding to a pressure P' such that $P_A - P'$ is constant regardless of the vapor flowrate $Q_V$. Similarly, the regulator 125 imposes a pressure P" such that $P'' - P_A$ is independent of $Q_V$.

The conditions for correct operation of this system are:

$$P_A - P' > R' Q_V^n$$

$$P'' - P_A > R'' Q_V^n$$

Provided that the above conditions are satisfied, the general equation (3) is written:

$$w = Q_V P_A / V_G P' + \alpha (P'' - P')$$

or $$w = Q_{1u} / V_G + \alpha (P'' - P')$$

The only parameters $p_i$ to be taken into consideration are $V_G$ and α, R' and R" no longer being included in the equation of the recovery circuit. $V_G$ is determined in the factory and α can be calculated at each dispensing from the equation:

$$\alpha = (w - Q_V P_A / V_G P') / (P'' - P')$$

or $$\alpha = (w - Q_{1u} / V_G) / (P'' - P')$$

The pressure inside the recovery tank 100 may not be equal to atmospheric pressure $P_A$, with a positive or negative pressure difference ΔPo due, for example, to the presence of a vent valve 130 shown in FIG. 1.

In this case, the general equation (3) becomes:

$$w = Q_V P_A / V_G P' + \alpha R Q^n_V + \alpha \Delta Po$$

The last term αΔPo is a correction term equivalent to an initial speed $w_i$. The latter can be determined during waiting periods between two dispensings as the minimal speed to be applied to the pump $P_V$ to obtain a non-zero vapor flowrate $Q_V$. The quantity $w - w_i$ is then treated as before with ΔPo=0.

Figure 5:
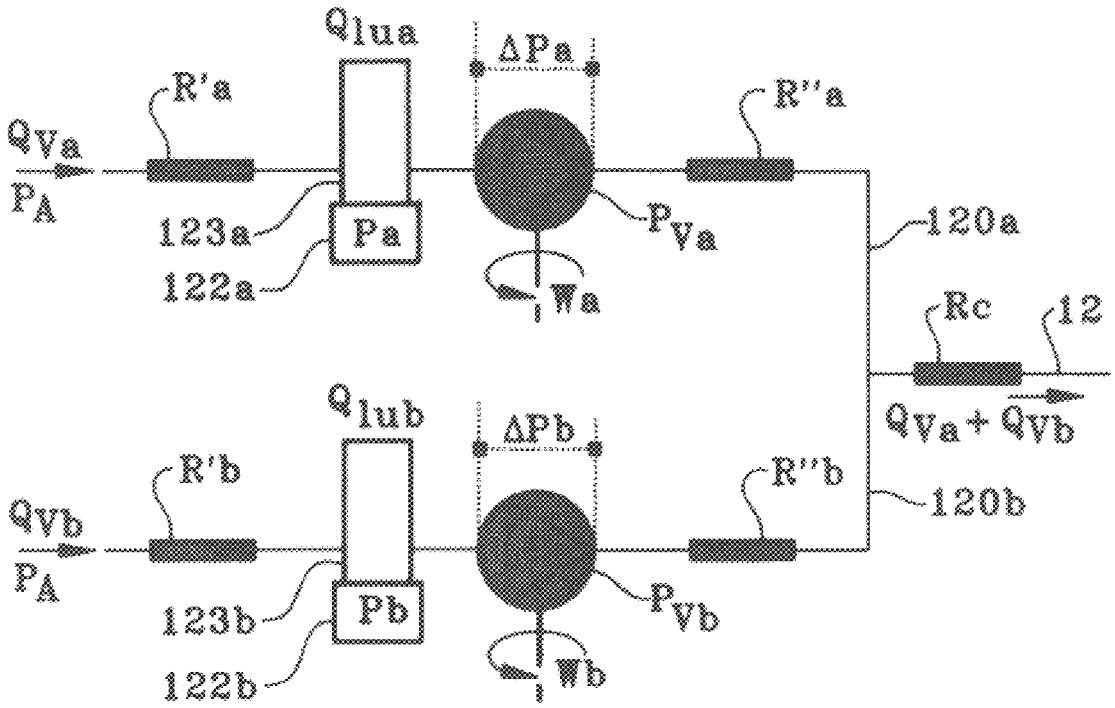
FIG. 5 is a schematic of a vapor recovery circuit with two recovery channels feeding a common pipe.

FIG. 5 shows the schematic of an installation in which two vapor pumps $P_{Va}$, $P_{Vb}$ feed a common small-bore pipe 12.

This is the case in fuel dispensing stations in particular where, to limit the cost associated with the hydrocarbon vapor recovery installation, a flexible tube is inserted in the suction pipe for returning vapor to the recovery tank 100. This tube is generally common to two pumps and has a common hydraulic resistance $R_c$ that can be high.

The two channels a and b of the FIG. 5 circuit being symmetrical, only the channel a is discussed.

The general equation concerning the flow of vapor in the channel a is written:

$$w_a=Q_{1ua}/V_{Ga}+\alpha_a\Delta Pa$$

with $$\Delta Pa=R_aQ_V{}^n{}_a+R_c(Q_{Va}+Q_{VG})^n$$

and $$R_a=R'a+R''a$$

Taking the approximate value of 2 for n:

$$w_a=Q_{1ua}/V_{Ga}+\alpha_a(R_a+R_c)Q^2{}_{Va}+\alpha_aRc(Q^2{}_{Vb}+2Q_{Va}Q_{VG})$$

The last two terms correspond to a single channel of hydraulic resistance $R_a+R_c$ and the third term is a correction term related to channel b.

If only channel a is delivering liquid, $Q_{Vb}=0$ and the third term is a null term. Of the first two terms, $\alpha_a$ $(R_a+R_c)$ is still deduced by means of measurements of the flowrate $Q_{1ua}$ (or $Q_{Va}$) and the pressure P'a by means of the flowmeter 123*a* and the pressure sensor 122*a*.

If both channels a and b deliver liquid simultaneously, the vapor flowrate and pressure measurements on channels a and b, associated with the term $\alpha_a$ $(R_a+R_c)$ calculated previously, enable $\alpha_a$ $R_c$ to be deduced.

Figure 6:
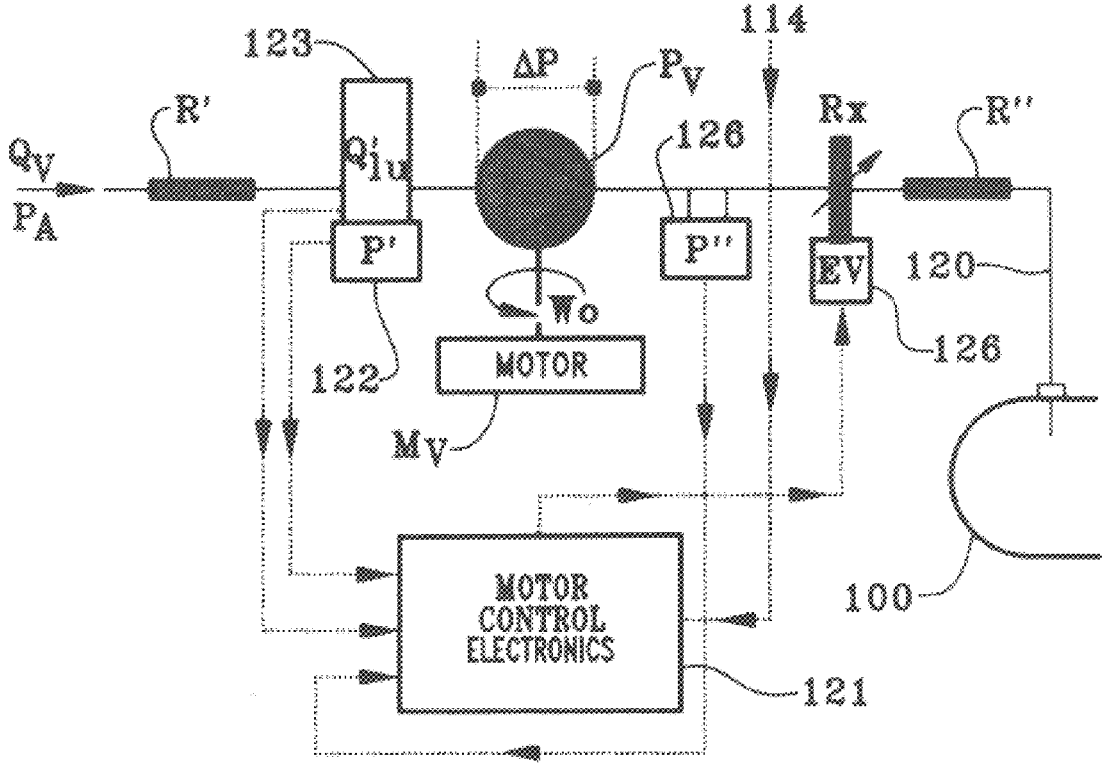
FIG. 6 is a schematic of the vapor recovery circuit from FIG. 1 with a regulator solenoid valve downstream of the recovery pump.

The FIG. 6 schematic shows a different embodiment of the vapor recovery method of the invention.

In this variant, the vapor is caused to flow in the recovery pipe 120 by a pump $P_V$ with a fixed rotation speed $w_o$ driven by a motor $M_V$.

The vapor flowrate $Q_V$ is regulated by a solenoid valve 126 downstream of the pump $P_V$ and having a variable hydraulic resistance Rx the value of which is imposed by a control circuit 121.

In this example, the parameter G characteristic of the recovery means is Rx, related to the speed $w_o$ of the pump $P_V$ and to the vapor flowrate $Q_V$ by the equation:

$$Rx=(w_o-Q_V/V_g\ (1-R'Q^nV/P_A)-(\alpha R)Q^n{}_V)/\alpha Q^2{}_V$$

with, $$R=R'+R''$$

The parameters $p_i$ to be determined are $V_G$, R', R and $\alpha$. Apart from $V_G$ , which is constant and measured in the factory, the other three parameters can be calculated from the measurements from the flowmeter 123 and from the pressure P' and P" supplied by the sensors 122 and 126:

$$R'=(P_A-P')/Q^n$$

$$R=R'+(P''-P_A-R_xQ^2{}_V)/Q^n{}_V$$

$$\alpha=(w_o-Q_V/V_G(1-R'Q^2)_V/P_A)/(RQ^n{}_V+R_aQ^n{}_V)$$

The solenoid valve 126 could equally well be disposed upstream of the vapor pump $P_V$, of course, which would yield a system of equations different from but equivalent to those just derived.

Similarly, allowing for a recovery tank pressure different from atmospheric pressure and for a return tube common to two pumps applies in the same way to the embodiment just described using a solenoid valve.

The foregoing description does not allow for any variation with the vapor flowrate $Q_V$ of the characteristic parameters governing the flow of vapor in the recovery pipe. For some types of pump the internal leakage coefficient a is known to depend on the vapor flowrate. In this case, an initial table is established by calibration on site, table $[(\alpha R)_o{}^j\ Q'_V{}^j]$ for parameter $\alpha R$, for example, relating N values (j=1, . . . , N) of $\alpha R$ to N corresponding values of $Q_V$:

| | | |
|---|---|---|
| 1 | $(\alpha R)_o{}^1$ | $Qv^1$ |
| . | . | . |
| 2 | $(\alpha R)_o{}^2$ | $Qv^2$ |
| . | . | . |
| j | $(\alpha R)_o{}^j$ | $Qv^j \leftarrow Q_{L1}$ |
| . | . | . |
| j' | $(\alpha R)_o{}^{j'}$ | $Qv^{j'} \leftarrow Q_{V1}$ |
| . | . | . |
| N | $(\alpha R)_o{}^N$ | $Qv^N$ |

On the first liquid dispensing k=1, the known liquid flowrate $Q_{L1}$ can be used to determine the value $(\alpha R)_1{}^j$, to be used in the general flow equation, namely:

$$[(\alpha R)_1{}^j,\ Q_V{}^j=Q_{L1}]$$

During this same dispensing, the vapor flowrate $Q_{V1}$ is measured and from it are deduced, on the one hand using the flow equations, a value $(\alpha R)_1$ of the parameter $\alpha R$ and, on the other hand, using the initial table, a value $(\alpha R)_o{}^{j'}$:

$$[(\alpha R)_o{}^{j'},\ Q_V{}^{j'}=Q_{V1}]$$

The values $Q_{L1}$ and $V_{V1}$ may not correspond exactly to values $Q_V{}^j$ from the table. Linear interpolation is then used.

A coefficient $A_1=(\alpha R)_1/(\alpha R)^{j'}{}_o$ is deduced for updating the whole of the table that will be used for the next dispensing by multiplying each value $(\alpha R)_o{}^j$ by the coefficient $A_1$.

The new table is written:

$$[(\alpha R)_1{}^j,\ Q_v{}^j \text{ with } (\alpha R)_1{}^j=A_1(\alpha R)_0{}^j \text{ for any j.}$$

The same procedure is followed for each dispensing, updating the table relative to the initial table stored in memory.

I claim:

1. A method of recovering vapor emitted in a liquid dispensing installation during the dispensing of a liquid into a tank, said installation comprising:

liquid dispensing means adapted to cause said liquid to flow with a liquid flowrate $Q_L$ between a storage tank and said tank;

vapor recovery means adapted to cause said vapor to flow with a vapor flowrate $Q_V$ along a pipe between said tank and a recovery tank, said vapor flowrate $Q_V$ being controlled by a parameter G (w ; $R_X$) characteristic of said recovery means;

said method including the following steps:

establishing an equation $$G=F(Q_V,\ \{p_i\})$$

relating the parameter G to the vapor flowrate $Q_V$ and to parameters $p_i$ characteristic of the recovery means and said pipe;

determining an initial value $\{p_i\}_o$ of the parameters $p_i$; and on each dispensing k of liquid:

measuring the liquid flowrate $Q_{LK}$ and determining a value $G_K$ of the parameter G to be imposed on the recovery means from the equation $$G_k=F(Q_{Lk}, \{p_i\}_{k-1}),$$

and determining a new value $\{p_i\}_k$ of the parameters $p_i$ to be used for the next dispensing k+1 of liquid;

wherein the recovery means comprises a pump, said parameter G is the rotation speed w of said pump, said pump having an internal leakage coefficient of value zero, said equation $$w=F(Qv, \{p_i\})$$

for a recovery tank at atmospheric pressure is given by:

$$w=Qv/V_G(1-R'Qv^n/P_A)$$

$V_G$ being the geometrical cyclic volume of the pump, R' the hydraulic resistance of the pipe upstream of the pump, n a coefficient equal to 7/4 and $P_A$ atmospheric pressure, and in the said parameters $p_i$ being the parameters $V_G$ and R', the constant parameter $V_G$ is determined by initial calibration of the pump, the value $R'_k$ of the parameter R' on each dispensing k being determined from the measured pressure P' at the inlet of the pump using the equations:

$$Q_{VK}=W_kV_GP'_k/P_A$$

$$R'_k=(P_A-P'_k)/Q^n_{vk}.$$

2. A method of recovering vapor emitted in a liquid dispensing installation during the dispensing of a liquid into a tank, said installation comprising:

liquid dispensing means adapted to cause said liquid to flow with a liquid flowrate $Q_L$ between a storage tank and said tank;

vapor recovery means adapted to cause said vapor to flow with a vapor flowrate $Q_V$ along a pipe between said tank and a recovery tank, said vapor flowrate $Q_V$ being controlled by a parameter G (w ; $R_X$) characteristic of said recovery means;

said method including the following steps:

establishing an equation $$G=F(Q_V, \{p_i\})$$

relating the parameter G to the vapor flowrate $Q_V$ and to parameters $p_i$ characteristic of the recovery means and said pipe;

determining an initial value $\{p_i\}_o$ of the parameters $p_i$; and on each dispensing k of liquid:

measuring the liquid flowrate $Q_{LK}$ and determining a value $G_K$ of the parameter G to be imposed on the recovery means from the equation $$G_k=F(Q_{Lk}, \{p_i\}_{k-1})$$

determining a new value $\{p_i\}_k$ of the parameters $p_i$ to be used for the next dispensing k+1 of liquid;

wherein the recovery means comprises a pump, said parameter G is the rotation speed w of said pump;

said pump having an internal leakage coefficient α with a non-zero value, said equation $$w=F(Qv, \{pi\})$$

is given by:

$$w=QV/V_G(1-R'Qv^n/P_A)+(\alpha R)Qv^n$$

$V_G$ being the geometrical cyclic volume of the pump, R' the hydraulic resistance of the pipe upstream of the pump, n a coefficient equal to 7/4, $P_A$ atmospheric pressure and R the total hydraulic resistance of the pipe, equal to the sum of the upstream hydraulic resistance R' and the hydraulic resistance R" of the pipe downstream of the pump, and wherein said parameters $P_i$ comprising $V_G$, R' and αR, the constant parameter $V_G$ is determined by initial calibration of the pump, the values $R'_k$ and $(\alpha R)_k$ of the parameters R' and αR on each dispensing k being determined from the measured vapor flowrate Qv and pressure P' at the inlet of said pump using the equations:

$$R'_k=(P_A-P'_k)/Q^n_{Vk}$$

$$(\alpha R)_k=[W_k-Q_{vk}/V_G(1-R'_kQ^n_{Vk}/P_A)]/Q^n_{Vk}.$$

3. The method of claim 2, wherein the value $R''_k$ of the hydraulic resistance R" downstream of the pump on each dispensing k is determined from the measured pressure P" at the pump outlet using the equation $$R''_k=(P_A-P''_k)/Q^n_{Vk}.$$

4. The method of claim 3, wherein said recovery tank has a pressure difference $\Delta p_o$ relative to atmospheric pressure, and there is added to the calculated values of the speed w of the pump a quantity $w_i$ equal to the minimal speed to be applied to the pump to obtain a non-zero vapor flowrate $Q_v$, said quantity $W_o$ being measured between two dispensings of liquid.

5. The method of claim 2, wherein said recovery tank has a pressure difference $\Delta p_o$ relative to atmospheric pressure, and there is added to the calculated values of the speed w of the pump a quantity $w_i$ equal to the minimal speed to be applied to the pump to obtain a non-zero vapor flowrate $Q_v$, said quantity $W_o$ being measured between two dispensings of liquid.

6. A method of recovering vapor emitted in a liquid dispensing installation during the dispensing of a liquid into a tank, said installation comprising:

liquid dispensing means adapted to cause said liquid to flow with a liquid flowrate $Q_L$ between a storage tank and said tank;

vapor recovery means adapted to cause said vapor to flow with a vapor flowrate $Q_V$ along a pipe between said tank and a recovery tank, said vapor flowrate $Q_V$ being controlled by a parameter G (w ; $R_X$) characteristic of said recovery means;

said method including the following steps:

establishing an equation $$G=F(Q_V, \{p_i\})$$

relating the parameter G to the vapor flowrate $Q_V$ and to parameters $p_i$ characteristic of the recovery means and said pipe;

determining an initial value $\{p_i\}_o$ of the parameters $p_i$; and on each dispensing k of liquid:

measuring the liquid flowrate $Q_{LK}$ and determining a value $G_K$ of the parameter G to be imposed on the recovery means from the equation $$G_k=F(Q_{Lk}, \{p_i\}_{k-1})$$

determining a new value $\{p_i\}_k$ of the parameters $p_i$ to be used for the next dispensing k+1 of liquid;

wherein the recovery means comprises a pump, said parameter G is the rotation speed w of said pump;

said pump having an internal leakage coefficient $\alpha$ with a non-zero value and the pressures P' and P" at the inlet and the outlet of pump being maintained constant by means of pressure regulators, said equation $$w=F(Qv, \{p_i\})$$

is given by:

$$w=Q_V P_A/V_G P'+a(P''-P')$$

where $V_G$ is the geometrical cyclic volume of said pump and $P_A$ atmospheric pressure, and wherein said parameters $p_i$ comprise the parameters $V_G$ and $\alpha$, the constant parameter $V_G$ is determined by initial calibration of said pump, the value $\alpha_k$ of the parameter $\alpha$ on each dispensing k being determined from the measured vapor flowrate $Q_V$ of said pump using the equation:

$$\alpha_k=(W_k-Q_{vk}P_A/V_G P')/(P''-P').$$

7. The method of claim 6, wherein said recovery tank has a pressure difference of $\Delta p_o$ relative to atmospheric pressure, and there is added to the calculated values of the speed w of the pump a quantity $w_i$ equal to the minimal speed to be applied to the pump to obtain a non-zero vapor flowrate $Q_v$, said quantity $W_o$ being measured between two dispensings of liquid.

8. A method of recovering vapor emitted in a liquid dispensing installation during the dispensing of a liquid into a tank, said installation comprising:

liquid dispensing means adapted to cause said liquid to flow with a liquid flowrate $Q_L$ between a storage tank and said tank;

vapor recovery means adapted to cause said vapor to flow with a vapor flowrate $Q_V$ along a pipe between said tank and a recovery tank, said vapor flowrate $Q_V$ being controlled by a parameter G (w; $R_X$) characteristic of said recovery means;

said method including the following steps:

establishing an equation $$G=F(Q_V,\{p_i\})$$

relating the parameter G to the vapor flowrate $Q_V$ and to parameters $p_i$ characteristic of the recovery means and said pipe;

determining an initial value $\{p_i\}_o$ of the parameters $p_i$; and on each dispensing k of liquid:

measuring the liquid flowrate $Q_{LK}$ and determining a value $G_K$ of the parameter G to be imposed on the recovery means from the equation $$G_k=F(Q_{Lk}, \{p_i\}_{k-1})$$

determining a new value $\{p_i\}_k$ of the parameters $p_i$ to be used for the next dispensing k+1 of liquid;

wherein the recovery means comprises a pump, said parameter G is the rotation speed w of said pump; and said recovery tank has a pressure difference $\Delta P_o$ relative to atmospheric pressure, and there is added to the calculated values of the speed w of said pump a quantity $w_i$ equal to the minimal speed to be applied to the pump to obtain a non-zero vapor flowrate $Q_V$, said quantity $w_o$ being measured between two dispensings of liquid.

9. The method of claims 1, 2, 3, 4, 5, 6, 7, or 8, wherein one parameter p of the parameters $p_i$ varies with the vapor flowrate $Q_V$ such that an initial table $[P_o^j, Q_v^j]$ (j=1, . . . , N) is established linking N values of the parameter p to N values of the vapor flowrate $Q_V$; and on each dispensing k of liquid:

in the equation $$G_k=F(Q_{Lk}, \{P_i\}_{k-1})$$

a value $p^j_{k-1}$ of the parameter p is used such that $$[p^j_{k-1}, Q^j_v=Q_{Lk}];$$

the vapor flowrate $Q_{Vk}$ is measured and a corresponding value $p_k$ of the parameter p is determined;

a coefficient $A_k$ is calculated such that $$A_k=P_k/p^{j'}_0 \text{ with } [p^{j'}_0, Q^{j'}_V=Q_{vk}]; \text{ and}$$

a new table $[p^j_k, Q^j_V]$ is established with $p^j_k=A_k p^j_0$ for any j.

10. A method of recovering vapor emitted in a liquid dispensing installation during the dispensing of a liquid into a tank, said installation comprising:

liquid dispensing means adapted to cause said liquid to flow with a liquid flowrate $Q_L$ between a storage tank and said tank;

vapor recovery means adapted to cause said vapor to flow with a vapor flowrate $Q_V$ along a pipe between said tank and a recovery tank, said vapor flowrate $Q_V$ being controlled by a parameter G (w ; $R_X$) characteristic of said recovery means;

said method including the following steps:

establishing an equation $$G=F(Q_V,\{p_i\})$$

relating the parameter G to the vapor flowrate $Q_V$ and to parameters $p_i$ characteristic of the recovery means and said pipe;

determining an initial value $\{p_i\}_o$ of the parameters $p_i$; and on each dispensing k of liquid:

measuring the liquid flowrate $Q_{LK}$ and determining a value $G_K$ of the parameter G to be imposed on the recovery means from the equation $$G_k=F\ (Q_{Lk},\ \{p_i\}_{k-1})$$

determining a new value $\{p_i\}_k$ of the parameters $p_i$ to be used for the next dispensing k+1 of liquid;

wherein said recovery means comprises a pump and a solenoid valve, said parameter G is the hydraulic resistance $R_x$ imposed by said solenoid valve, and the rotation speed w of the pump is constant;

said solenoid valve being disposed downstream of said pump, said pump having a non-zero internal leakage coefficient α, the equation $R_x=F(Q_V,\ \{p_i\}$ is given by:

$$Rx=[W_o-Q_V/V_G(1-R'Q^nV/P_A)-(\alpha R)Q^nV]/\alpha Q^2{}_V$$

$V_G$ being the geometrical cyclic volume of the pump, R' the hydraulic resistance of the pipe upstream of the pump, n a coefficient equal to 7/4, $P_A$ atmospheric pressure, R the hydraulic resistance of the pipe, equal to the sum of the upstream hydraulic resistance R' and the hydraulic resistance R" downstream of the pump, and wherein said parameters $p_i$ comprising $V_G$, R', R and α, the constant parameter $V_G$ is determined by initial calibration of the pump, the values $R'_k$, $R_k$ and $\alpha_k$ of the parameters R', R and α on each dispensing k being determined from the measured vapor flowrate $Q_V$ and pressures p' and P" at the inlet and at the outlet of the pump from the equations:

$$R'_k=(P_A-P'_k)Q^n{}_{Vk}$$

$$R_k=R'_k+(P''_k-P_A-R_{xk}Q^2{}_{Vk})/Q^n{}_{Vk}$$

$$\alpha k=[W_o-Q_{Vk}/V_G(1-R'kQ^n{}_{Vk}/P_A)]/(R_kQ^n{}_{Vk}+R_{xk}Q^w{}_{Vk}).$$

11. The method of claim 10, wherein one parameter p of the parameters $p_i$ varies with the vapor flowrate $Q_V$ such that an initial table $[P_o^j,\ Q_v^j]$ (j=1, . . . , N) is established linking N values of the parameter p to N values of the vapor flowrate $Q_V$; and on each dispensing k of liquid:

in the equation $$G_k=F(Q_{Lk},\ \{P_i\}_{k-1})$$

a value $p^j{}_{k-1}$ of the parameter p is used such that $$[p^j{}_{k-1},\ Q^j{}_V=Q_{lk}];$$

the vapor flowrate $Q_{Vk}$ is measured and a corresponding value $p_k$ of the parameter p is determined;

a coefficient $A_k$ is calculated such that $A_k=P_k/p^{j'}{}_0$ with $[p^{j'}{}_0,\ Q^{j'}{}_V=Q_{vk}]$; and a new table is established with $p^j{}_k=A_kp^j{}_0$ for any j.

* * * * *